US006675466B2

(12) United States Patent
Fantini

(10) Patent No.: US 6,675,466 B2
(45) Date of Patent: Jan. 13, 2004

(54) INTAKE DEVICE FOR CONNECTORS AND CRIMPING STATION PROVIDED WITH SUCH A DEVICE

(75) Inventor: Flavio Fantini, Puteaux (FR)

(73) Assignee: FCI, Courbevoie (FR)

( * ) Notice: Subject to any disclaimer, the term of this patent is extended or adjusted under 35 U.S.C. 154(b) by 0 days.

(21) Appl. No.: 10/056,289

(22) Filed: Jan. 23, 2002

(65) Prior Publication Data

US 2002/0129493 A1 Sep. 19, 2002

(30) Foreign Application Priority Data

Jan. 23, 2001 (FR) ..... 01/01182

(51) Int. Cl.[7] ..... H01R 43/20

(52) U.S. Cl. ..... 29/747; 29/749; 29/757; 29/758; 29/751; 29/761

(58) Field of Search ..... 29/747, 749, 751, 29/753, 757, 761, 838, 844, 758; 439/422, 492, 494, 495, 499

(56) References Cited

U.S. PATENT DOCUMENTS 3,697,925 A 10/1972 Henschen ..... 339/17 F
4,235,015 A * 11/1980 Funcik et al. ..... 29/857
4,392,301 A * 7/1983 Hannes et al. ..... 29/741
4,583,287 A * 4/1986 McDevitt et al. ..... 29/741
4,749,368 A 6/1988 Mouissie ..... 439/421
5,127,153 A * 7/1992 Mitra ..... 29/753
5,327,641 A * 7/1994 Olsson ..... 29/747

FOREIGN PATENT DOCUMENTS

GB 690782 4/1953
GB 915566 1/1963

OTHER PUBLICATIONS

"SAE Technical Paper Series 870553 Flex–Foil Crimp Technology", B. Mouissie, International Congress And Exposition, 1987.

* cited by examiner

*Primary Examiner*—Carl J. Arbes
*Assistant Examiner*—Tai Nguyen
(74) *Attorney, Agent, or Firm*—Perman & Green, LLP

(57) ABSTRACT

Intake device for connector modules between two treatment posts for these modules, the device having a holding arm for the modules provided with a comb positioned at the end of an arm, the comb coming to hold the connector at the level of the paddles joined with the contacts borne by the connector, the comb driving the modules between an intake post for the connectors and a crimping post for the flexible circuit onto the connector contacts.

6 Claims, 5 Drawing Sheets

INTAKE DEVICE FOR CONNECTORS AND CRIMPING STATION PROVIDED WITH SUCH A DEVICE

BACKGROUND OF THE INVENTION

The invention concerns a device for bringing connector modules to a crimping post and a station for crimping contacts onto flexible circuits, which is particularly designed for the assembly and creation of flexible circuit bundles provided with connectors.

Flexible circuits are electrical circuits comprising an insulating sheet on which conductive tracks are arranged, these tracks being themselves possibly covered with a second protective insulating sheet.

Such circuits are notably coupled to electrical contacts by a technique of piercing the insulation and crimping, and the use of contacts provided with a crimping end having points arranged in a crown and orientated perpendicularly to the flexible circuit to be coupled is known for this purpose. Document U.S. Pat. No. 4,749,368 notably describes the creation of contact elements and the coupling of components provided with connection points arranged in a crown.

Contacts are crimped onto the flexible circuit traditionally by positioning the contacts under the flexible circuit facing the conductive tracks of the flexible circuit and then by crimping the contacts onto the flexible circuit. In order to guarantee a correct crimping of the contacts onto the flexible circuit, a correct alignment of the contacts relative to the flexible circuit is desired to guarantee a correct alignment. In particular, for a connector provided with a plurality of contacts, it is desired to guarantee an alignment of the crimping points with the conductive tracks of the flexible circuit and to correctly position the crimping points for example, organized in crowns, relative to crimping matrices.

A crimping process using pins which come to crimp the contacts onto a flexible circuit, for example, is described in the document "SAE technical paper series 870553 Flex foil crimp technology—International Congress and Exposition, Detroit, Mich., Feb. 23–27, 1987.

The diameter of the crowns and the width of the tracks of the flexible circuit are of the order of a few millimeters for circuits and contacts designed to conduct currents of the order of a few amperes. A great precision in the positioning of the contacts relative to the flexible circuit is therefore desired.

The device which is the subject of the present invention is designed for the preparation of connectors provided with a plurality of contacts in view of their crimping. In this type of connector, the contacts have an end part for coupling to a flexible circuit on one side and an end part for connection with a complementary contact on the other side, the contacts and the flexible circuit being taken up in an insulated housing provided with an open zone that thus releases the zone for crimping the contacts onto the flexible circuit above and below the crimping zone.

In order to crimp the contacts, a device is used that has an anvil, which forms a lower support surface for the electrical contact elements and a mobile pressing device provided with a block whose surface parallel to the plane of alignment of the contacts bears a plurality of crimping matrices.

The flexible circuit is then positioned on the paddles and the block is applied by the press onto the flexible circuit, each of the matrices strongly and locally applying the flexible circuit onto the points so as to pierce the flexible circuit and then to bend the points which thus come to crimp the paddles onto the flexible circuit and bring about the electrical connection between the contacts and the tracks of the flexible circuit.

SUMMARY OF THE INVENTION

In view of creating a complete automatic crimping station, the invention proposes creating an automated intake device for these connectors with their pre-mounted contacts.

For this, the invention proposes to create a device for bringing the connector unit modules to the crimping post, the device being provided with a comb positioned at the end of an arm that is in turn joined with a transport device, the comb having teeth for holding and realigning the paddles, the comb forming a component for moving the connector modules.

Thus, simultaneously with the moving of the modules, the paddles provided with crimping points for each contact are pre-positioned both longitudinally and laterally during the transport of the connectors to the crimping post in order to assure a precise alignment between the conductive tracks of the flexible circuit and the crimping crowns.

The invention is particularly designed for connectors of the type provided with a window for release from the crimping zone and is also provided with a holding flap for the flexible circuit in the form of an open frame. The comb is designed to be introduced between the arms of the frame.

BRIEF DESCRIPTION OF THE DRAWINGS

The invention will be better understood upon reading the description that will follow of one non-limiting example of embodiment in reference to the figures which show.

DETAILED DESCRIPTION OF THE PREFERRED EMBODIMENTS

Figure 1:
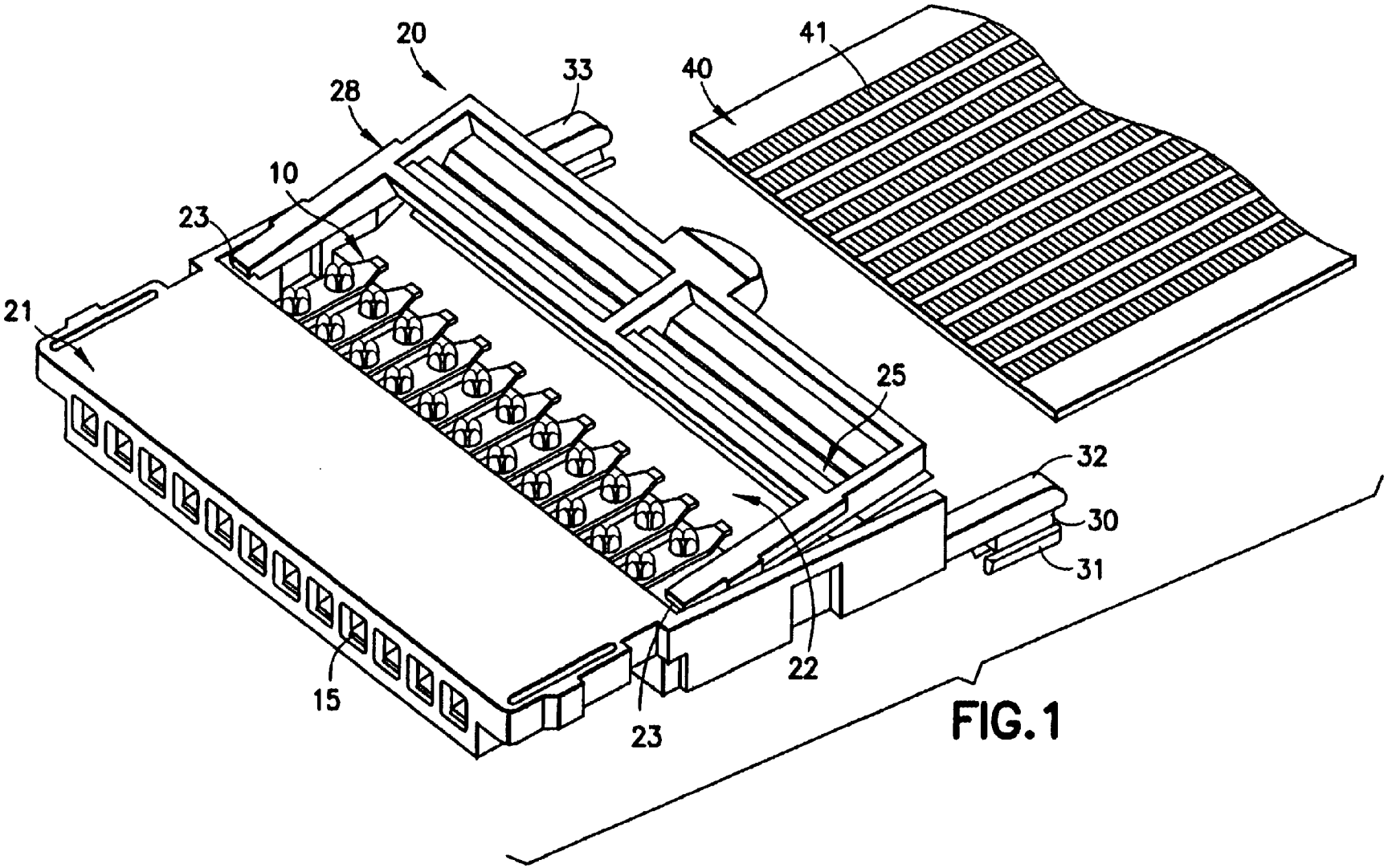
In FIG. 1: an example of the connector module for the flexible circuit to which the invention can be applied.
Figure 2A:
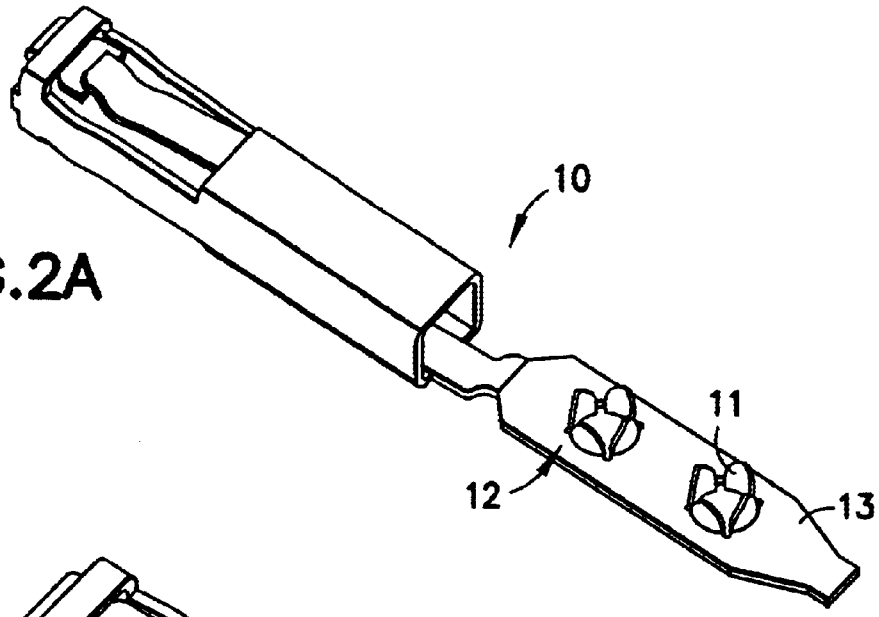
In FIGS. 2A and 2B: examples of contacts that can be crimped onto the flexible circuit.
Figure 2B:
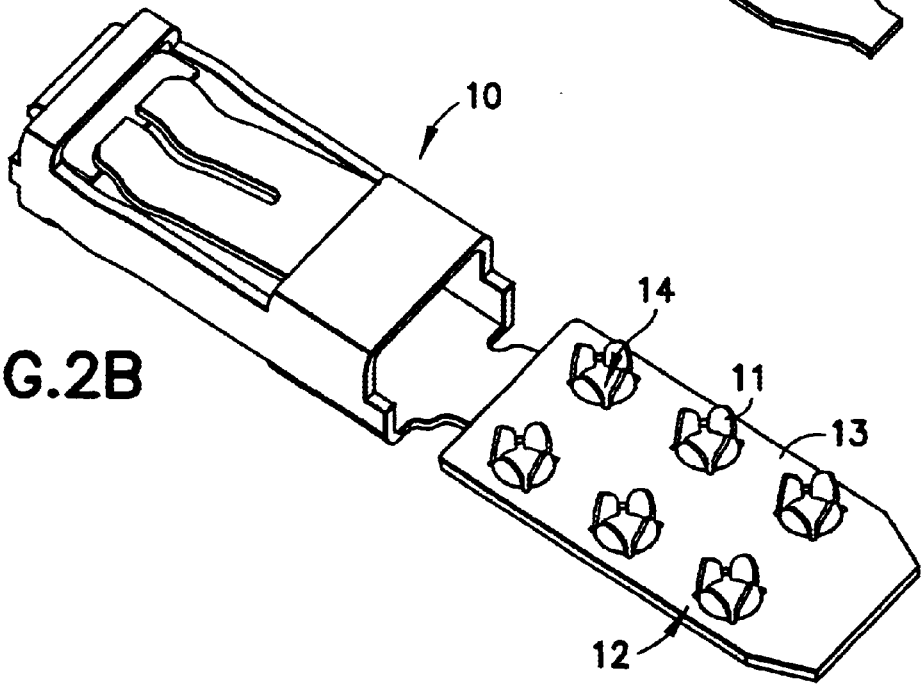

According to FIG. 1, a connector 20 designed for crimping onto a flexible circuit 40 is described. The connector 20 is provided with a plurality of contacts 10. In this type of connector, the contacts have an end for coupling to a flexible circuit 40 on one side, this end having a paddle 13 provided with points 11 arranged in a crown 12, the points being made by cross-punching the paddle and then stamping the paddle to fold back the points and open up a circular hole 14 forming crown 12 (see FIGS. 2A–2B).

On the other side, the contacts have an end piece 15 for connection with a complementary contact, the contacts and the flexible circuit being taken up in an insulating casing 21 provided with an open zone 22 releasing the crimping zone for the contacts onto the flexible circuit above and below the crimping zone.

Figure 5:
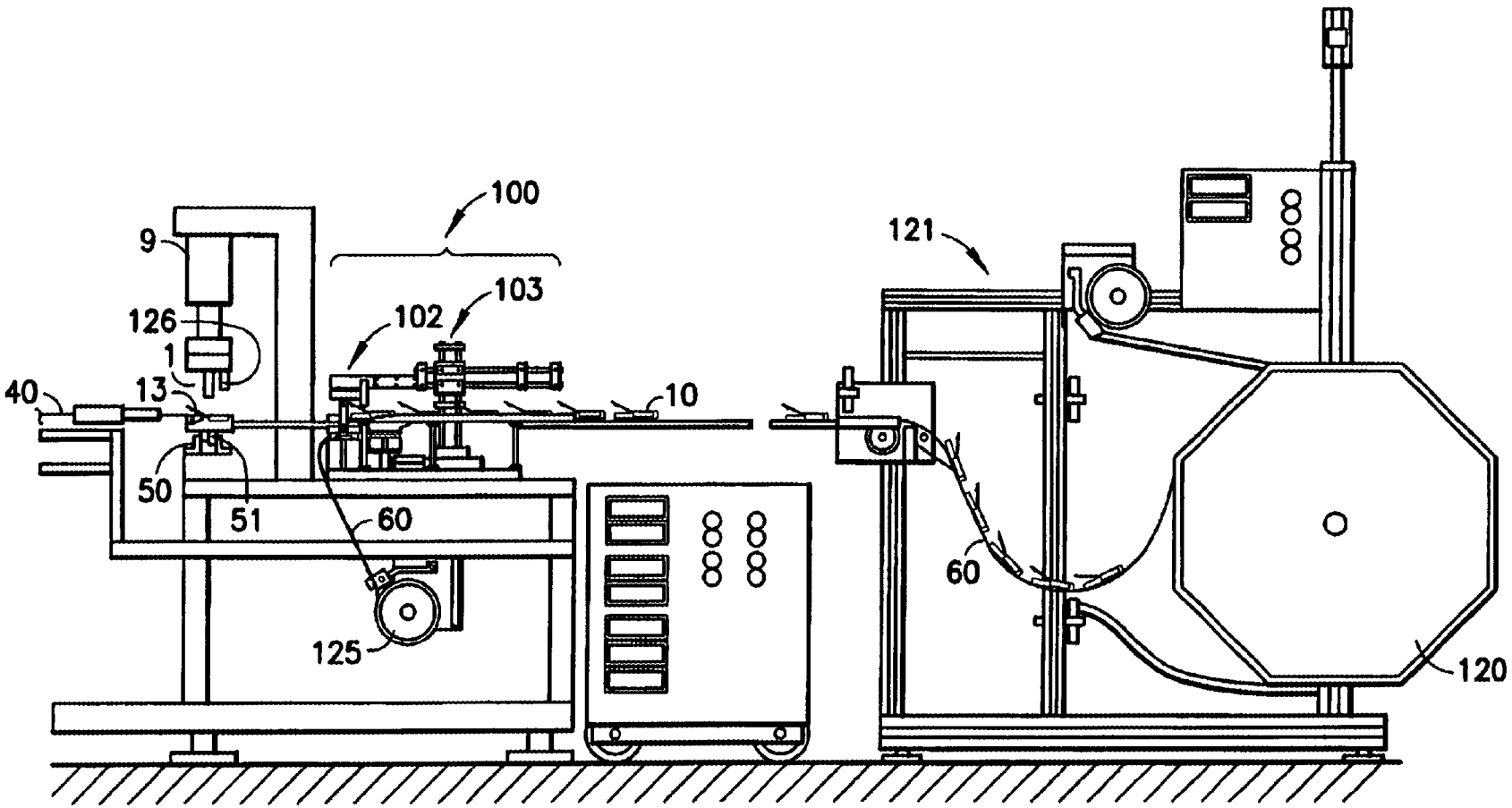
In FIG. 5: an overall view of a crimping machine using a device according to the invention.

FIG. 5 shows a general view of a machine or post for simultaneous crimping onto a flexible circuit of electrical contact elements aligned in a plane and arranged in a connector casing.

In order to crimp the contacts, the device visible in FIG. 5 has on one side an anvil 50 forming a lower support surface for electrical contact elements 10, and the crimping device has on the other side a mobile pressing device 9 provided with a block 1 whose surface parallel to the plane of alignment of the contacts has a plurality of crimping matrices. Press 9 also has a component 126 for holding the connector casing during crimping.

The anvil 50 arranged under paddles 13 can comprise at least one positioning element 51 and advantageously two positioning elements arranged facing the crowns of two contacts arranged at each end of flexible circuit 40, each positioning element being introduced into a circular hole of a crown.

Flexible circuit 40 is then positioned on paddles 13 and the block is applied by the press onto the flexible circuit, the paddles being supported on the anvil 50, each of the matrices on the block strongly and locally applying flexible circuit 40 onto points 11 (see FIGS. 2A–2B) so as to pierce the flexible circuit and the tracks 41 (see FIG. 1) and then to bend the points that thus come to crimp the paddles onto the flexible circuit and to effect the electrical connection between contacts 10 and conductive tracks 41 of the flexible circuit.

The anvil and press assembly provided with a crimping block thus constitutes a crimping post.

In order to create a completely automatic crimping station having a crimping post, it is desired to provide an automated intake device 100 for these connectors with their pre-mounted contacts.

Figure 6:
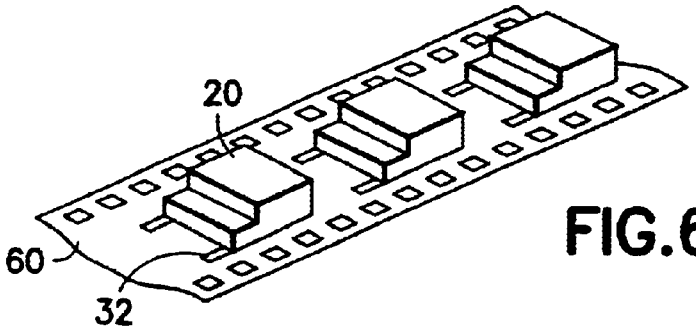
In FIG. 6: a schematic view of connectors on the bearing belt of the device.

As is visible in FIG. 6, the connectors can be arranged on a bearing belt 60, these connectors being ratcheted on the bearing belt provided with rollers, so that a feed device for the crimping station then has a continuous unrolling post 121.

Figure 3A:
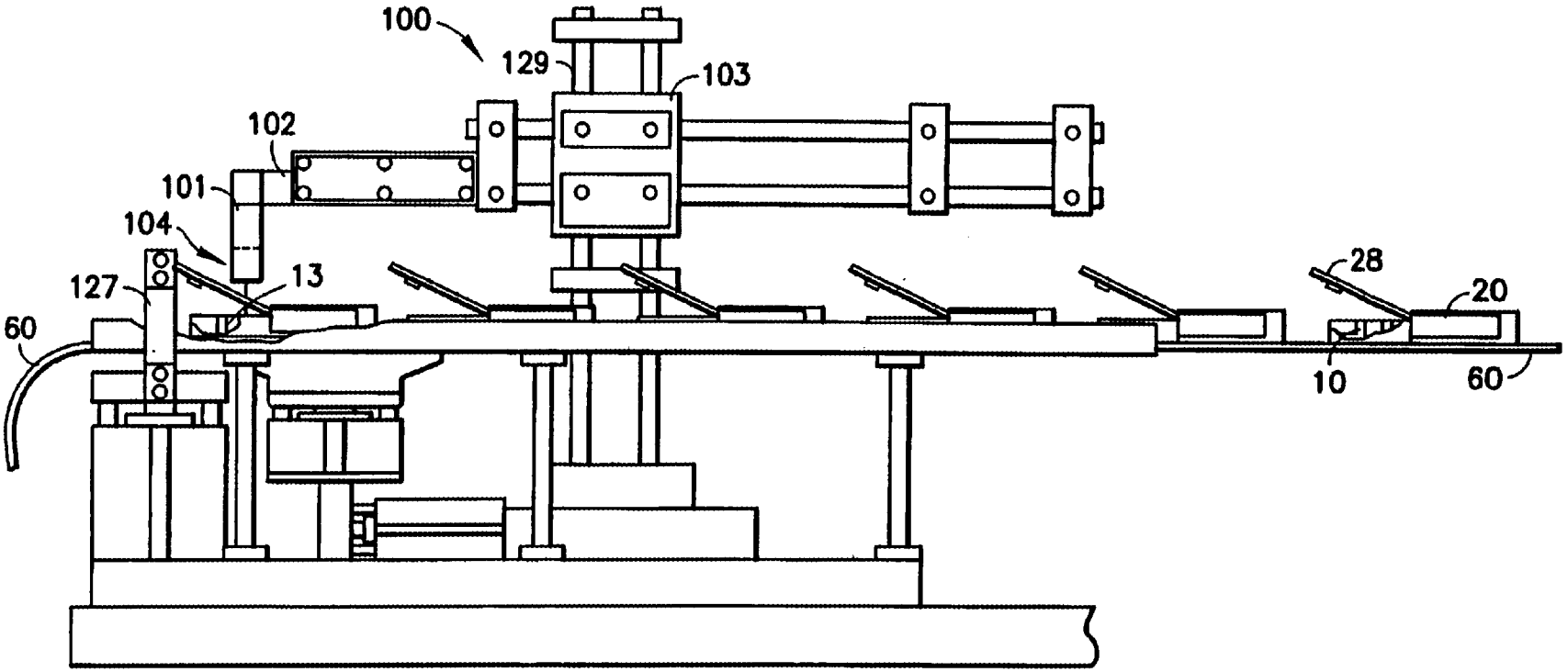
In FIG. 3A: a general view of an intake device for connector modules conforming to the invention.

Referring now also to FIG. 3A, in the case where the connectors are arranged on a bearing belt 60, the station will have, after the unrolling post, a device for separating the connectors from the bearing belt and device 100 for bringing the connector units to the crimping station.

Figure 3B:
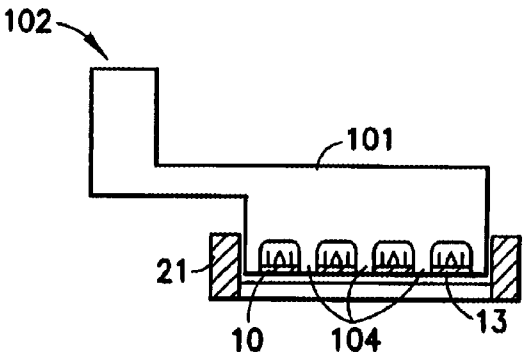
In FIG. 3B: a detail element from FIG. 3A.

More precisely, the intake device visible in FIG. 3A is provided with a comb 101 visible in FIG. 3B positioned at the end of an arm 102, and in turn this arm is perpendicularly joined with a handling device 103. Handling device 103 can combine a jack 129 activated in the vertical direction and a jack operating in the horizontal direction or other means of activation such as electrical motors acting on a vertical toothed-rack system and a horizontal toothed-rack system.

In order to catch hold of connector 20, the comb has teeth 104 for holding and realigning paddles 13. Thus, when the arm descends and catches hold of the connector, the paddles provided with crimping points for each contact are pre-positioned both longitudinally and laterally. In addition, during transport of the connectors to the crimping post, paddles 13 are held so as to assure a precise alignment between conductive tracks 41 of the flexible circuit and the crimping crowns.

The invention is particularly designed for connectors of the type provided with a window for releasing the crimping zone and, moreover, provided with a holding flap 28 for the flexible circuit The flap can have a frame connected by a hinge 23 to a casing for the connector taking up the contacts.

The frame permits conducting the crimping operation through flap 28, the flap being closed after the crimping operation, this flap 28 having a rear arm provided with one or more protrusions 25 for supporting and placing the flexible circuit under pressure in order to isolate and protect the crimping zone from possible stresses applied onto the flexible circuit from outside the connector.

Figure 4D:
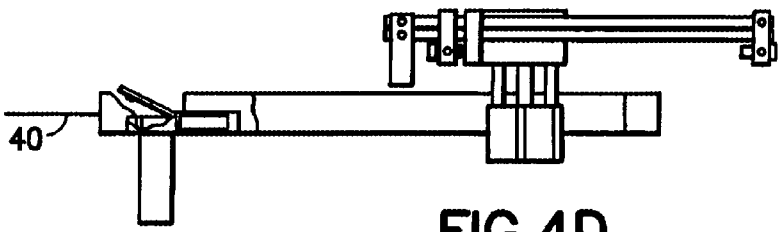
In FIGS. 4A to 4D: various positions for operation of the device according to the invention.
Figure 4A:
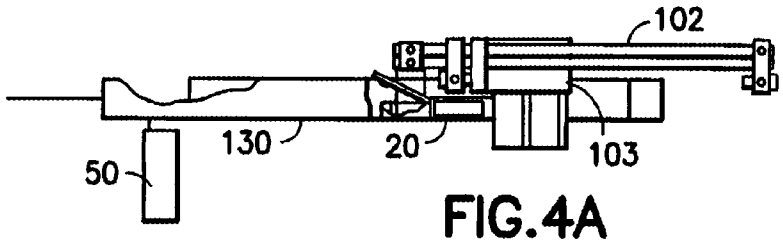

As is visible in FIG. 4A, the comb borne by its arm comes to catch hold of paddles 13 through the frame formed by flap 28.

The holding of the connector modules on the bearing belt can be assured by clipping pins 30 provided with catches 31 hooking into holes of the bearing belt; these pins, which are visible in FIG. 1 are arranged on tabs 32 extending beyond the body of the module in a direction parallel to the bearing belt.

At the level of the intake device for the connector, a cutting device 127 (see FIG. 3A) is provided for tabs 32, 33, so as detach the modules from the belt at the level of this post.

The operation of the intake device is described in FIGS. 4A to 4D.

In a first step, as shown in FIG. 4A, arm 102 is retracted toward the rear and the jack or vertical drive device 129 then lowers the arm and therefore comb 101 in the frame until teeth 104 of the comb are intercalated between paddles 13. The connector is thus held in place while cutting device 127 cuts tabs 32, 33 and thus releases the connector from the bearing belt which returns to the bottom of the cutting post.

Figure 4B:
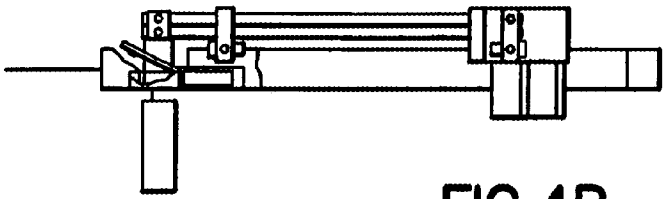
Figure 4C:
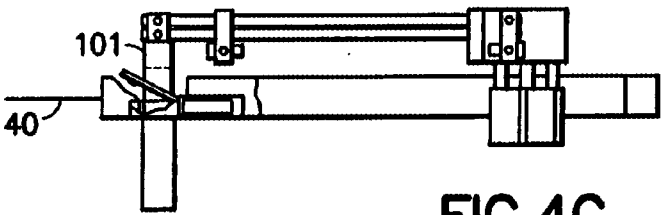

As is visible in FIG. 4B, the arm is moved horizontally and is extended toward the front, moving by sliding the connector over a mat 130 up to the crimping post. A holding device (not shown) then holds the connector while the arm is raised again under the action of jack 129. The arm retracts and retakes its standby position visible in FIG. 4D to receive a new connector while flexible circuit 40 is brought onto the paddles to permit the crimping operation.

What is claimed is:

1. A connector module processing apparatus having bearing belt posts for moving connector modules in a process direction in the apparatus and an intake device between bearing belt posts, the intake device comprising:

a frame;

a handling device movably connected to the frame so that part of the handling device is capable of moving relative to the frame; and an arm connected to the handling device to move with the part of the handling device relative to the frame, the arm having a comb with teeth for holding and aligning contact paddles of a connector module being processed by the apparatus, wherein the comb drives the connector module in the process direction between the bearing belt posts of the apparatus.

2. The apparatus according to claim 1, further characterized in that the device has a support mat for the modules on which the modules slide.

3. The apparatus according to claim 1, further characterized in that the device has a complementary driving mat for the modules.

4. The apparatus according to claim 1, further characterized in that comb comes to be inserted into a window providing a crimping zone for contacts through a flap of module.

5. The apparatus according to claim 1, further characterized in that the device has a device for detaching connector modules from a bearing belt.

6. The apparatus according to claim 5, further characterized in that the detaching device comprises a cutting tool that cuts tabs holding connector modules on bearing belt.

* * * * *